US006758573B1

(12) United States Patent
Thomas et al.

(10) Patent No.: US 6,758,573 B1
(45) Date of Patent: Jul. 6, 2004

(54) UNDERCABINET LIGHTING WITH LIGHT EMITTING DIODE SOURCE

(75) Inventors: Edward J. Thomas, Streetsboro, OH (US); Wordell Nelson, South Euclid, OH (US); Hesham M. Elghoroury, Solon, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/604,468

(22) Filed: Jun. 27, 2000

(51) Int. Cl.[7] ..... F21V 33/00

(52) U.S. Cl. ..... 362/133; 362/295; 362/231; 362/800

(58) Field of Search ..... 362/133, 800, 362/127, 249, 250, 251, 252, 235, 236, 244, 295, 394, 230, 231, 20, 277, 317, 125, 267

(56) References Cited

U.S. PATENT DOCUMENTS 4,924,363 A * 5/1990 Kornelson ..... 362/125
5,301,090 A * 4/1994 Hed ..... 362/558
5,548,494 A * 8/1996 Blackman ..... 362/183
5,791,768 A * 8/1998 Splane, Jr. ..... 362/280
5,887,969 A * 3/1999 Gordin ..... 362/347
5,998,928 A * 12/1999 Hipp ..... 315/77
6,283,612 B1 * 9/2001 Hunter ..... 362/249

* cited by examiner

*Primary Examiner*—Sandra O'Shea
*Assistant Examiner*—Bao Q Truong
(74) *Attorney, Agent, or Firm*—Fay, Sharpe, Fagan, Minnich & Mckee, LLP

(57) ABSTRACT

An apparatus (A) for improving the performance of undercabinet lighting includes a housing (10) that receives a plurality of light emitting diodes (LEDs) (28, 30, 32). The LEDs serve as the light source and an optical assembly focuses and disperses the LED output to a desired light contour. The undercabinet lighting assembly further includes a switch (44) formed from a variable resistor adapted to control the level of optical output. The switch is adapted to turn on and off any select number of LEDs. A battery pack (70) having a battery source is enclosed by the housing for providing back up power and emergency lighting. In a preferred embodiment, the battery source automatically provides power to the undercabinet lighting assembly upon primary power failure.

26 Claims, 4 Drawing Sheets

UNDERCABINET LIGHTING WITH LIGHT EMITTING DIODE SOURCE

BACKGROUND OF THE INVENTION

1. Field of the Invention

This invention pertains to an apparatus for improving the performance of undercabinet lighting by providing a longer lighting life and higher efficacy. More particularly, the invention relates to improving undercabinet lighting by replacing a standard fluorescent or incandescent lamp with a light emitting diode (LED) light source.

2. Discussion of the Art

Conventional undercabinet lighting utilizes fluorescent or incandescent lamps as a light source. Fluorescent and incandescent lamps generally require filaments and cathode tubes for operation. They are fragile and require careful handling and, in addition, filament lamps have a relatively short operating life. Furthermore, filament lamps are not the most economical. Fluorescent lamps have a relatively high start up power consumption. Accordingly, new ways to provide more efficient lighting are constantly under consideration.

Light Emitting Diodes (LEDs) have made significant advances in providing a higher performing light source since their inception in the 1960's. Red-emitting AlGaAs LEDs were developed with external quantum efficiencies greater than 10%, such devices being more energy efficient and longer lasting producers of red light than red-filtered incandescent bulbs. As a result, LEDs have become cost effective replacements for standard incandescent light sources in various applications, such as automotive brake lights. Moreover, high-efficiency LEDs have been developed and are commercially available in the blue and blue/green wavelength range based on the InGaN and AlGaN material systems. Most recently, LEDs have been developed in the green and yellow color range with an external quantum efficiency greater than 1%.

The advent of UV and blue LEDs allowed the possibility to generate white light from an LED by applying luminescent phosphor materials on top of the LED. This layer of phosphor partially transforms the UV or blue light into longer wavelengths, e.g. yellow light. Successful implementation of such a device is dependent upon the efficient conversion of UV/blue light into visible light of the desired wavelength and the subsequent efficient extraction of the generated visible light from the device. However, the first commercially available white light LED systems were not competitive with standard light sources with respect to performance since the phosphor layer only partially transformed the UV or blue light into longer wavelengths. Not until recently have devices and methods been developed for efficiently converting UV/Blue light into visible light.

White-light LED systems provide significant benefits over traditional fluorescent and incandescent lamps. As white light producing LED systems become more refined and efficient, a need exists to expand the use of such systems into other areas, such as undercabinet lighting. As already discussed, the current fluorescent and incandescent lamps used in undercabinet lighting have multiple components (increasing the cost to manufacture), are fragile, and have a relatively short operating life. Furthermore, conventional undercabinet lighting is subject to failure upon power outages. Constructing undercabinet lighting with an LED as its light source and a battery back-up system would alleviate most, if not all, of the foregoing problems. To date, no device exists which adequately utilizes an LED system in undercabinet lighting. Therefore, it would be advantageous to provide an LED light source for undercabinet lighting which replaces the traditional filament or fluorescent lamp with an LED light source.

BRIEF SUMMARY OF THE INVENTION

A new and improved apparatus is provided for improving the performance of undercabinet lighting by replacing the fluorescent and incandescent lamps found in traditional undercabinet lighting assemblies with a light emitting diode.

An improved undercabinet lighting assembly includes a fixture or housing. A first plurality of light emitting diodes (LEDs) is mounted within the housing forming at least one array of LEDs. The array of LEDs serves as a light source and generates a light pattern. At least one optical assembly is operatively associated with the housing for focusing and dispersing the light pattern.

One advantage of the present invention is the provision of undercabinet lighting having a longer lighting life and increased reliability.

Another advantage of the present invention resides in the reduced cost of manufacturing undercabinet lighting due to the decreased number of required components.

Another advantage of the present invention is the provision of an undercabinet lighting assembly having a minimal cost of operation due to the inherently low power consumption of the device.

Another advantage of the present invention is provided by a battery back-up system which allows for emergency lighting in the case of primary power failure.

Another advantage of the present invention is provided by the ability to control the life of a battery source used for the battery back up system.

Yet another advantage of the present invention is the provision of undercabinet lighting capable of being manufactured having several different shapes.

Yet another advantage of the present invention is the provision of emergency powerfail lighting which is energized upon primary power failure.

Still another advantage of the present invention is the provision of a switch in the form of a variable resistor allowing control over the intensity of and the number of LEDs in operation.

Still other benefits and advantages of the invention will become apparent to those skilled in the art upon a reading and understanding of the following detailed specification.

DETAILED DESCRIPTION OF THE INVENTION

Figure 1:
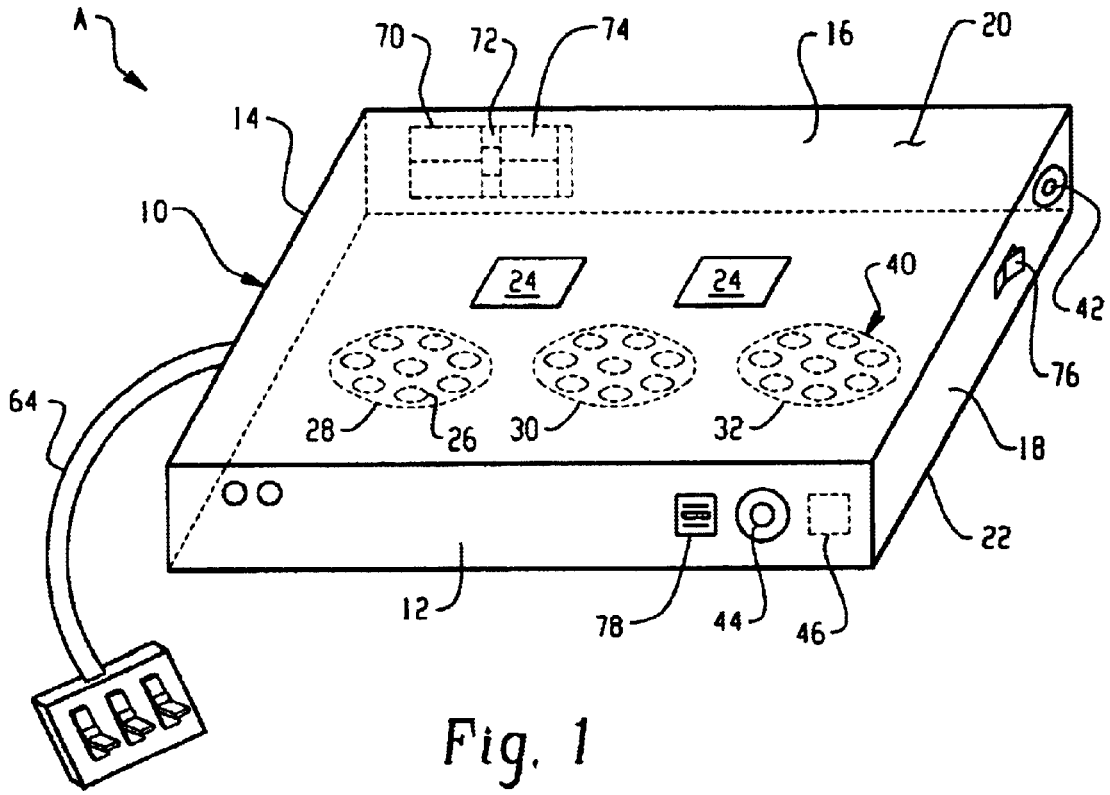
FIG. 1 is a perspective view of an undercabinet lighting assembly in accordance with the present invention.

FIG. 1 shows a perspective view of an undercabinet lighting assembly A in accordance with the present invention. The lighting assembly includes a fixture or housing 10 enclosing the necessary lighting components and circuitry. The housing is defined by four side walls 12, 14, 16, 18 and an upper and lower face 20, 22. The housing is preferably rectangular in shape, but any other shape is contemplated by the present invention. A fixing apparatus 24 is located on the upper face 20 of the housing. The fixing apparatus may include magnets, fixing posts, or keyholes adapted to receive the flanged heads of fasteners.

Figure 2:
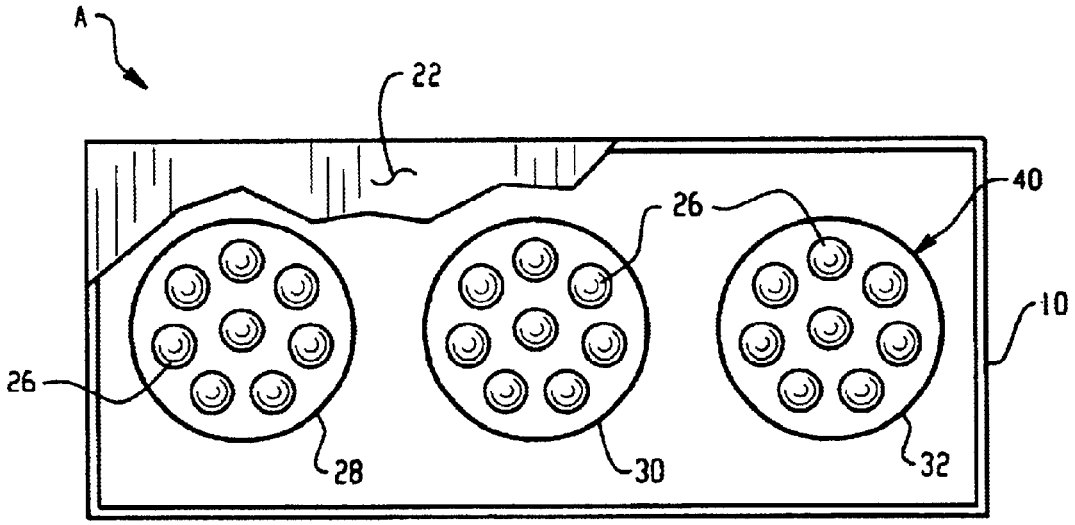
FIG. 2 is bottom view of an undercabinet lighting assembly in accordance with the present invention.
Figure 3:
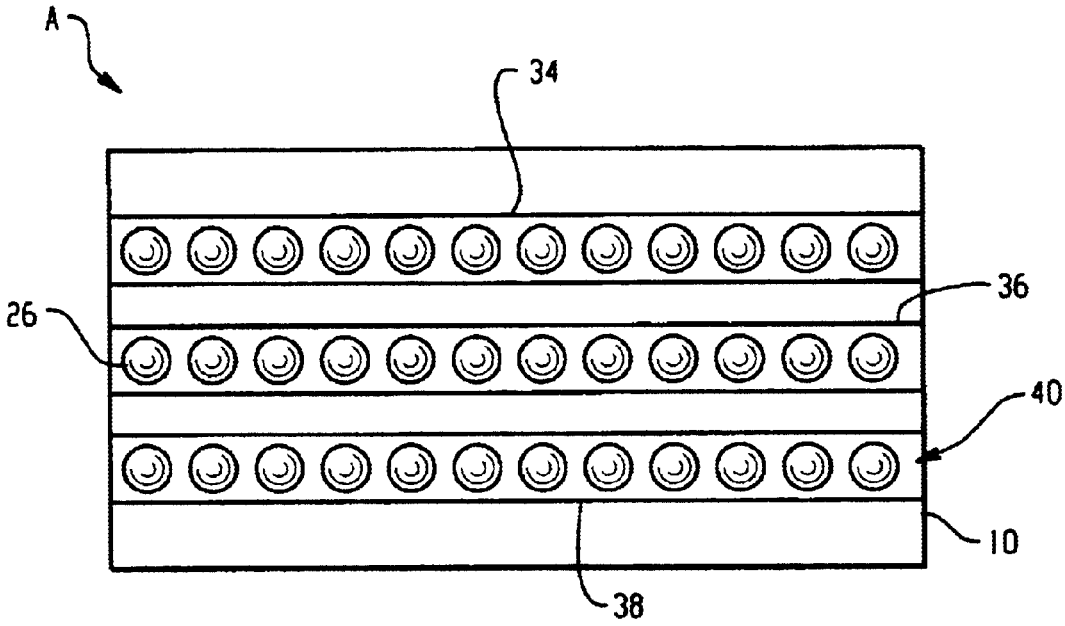
FIG. 3 is a bottom view of another preferred undercabinet lighting assembly in accordance with the present invention.

With continued reference to FIG. 1, and further reference to FIG. 2, a plurality of light emitting diodes (LEDs) 26, mounted within the housing 10, operate as the light source for the undercabinet lighting assembly A. The LEDs of the present invention replace the standard fluorescent or incandescent lamp and associated hardware, such as ballasts and sockets, that are used in conventional undercabinet lighting. The plurality of LEDs from which the light source is made, form at least one array of LEDs. In the illustrated embodiment, three LED arrays 28, 30, 32 are shown, each grouped in a substantially circular configuration. However, it will be appreciated that any number of LED arrays, grouped in any desired configuration are within the scope and intent of the present invention. For example, the LEDs may be placed in rows forming linear arrays 34, 36, 38 as best shown in FIG. 3. The LEDs 26 in each array can be formed of multiple colors of spectral output, thereby giving the desired light output, light level, and beam characteristics.

Figure 4:
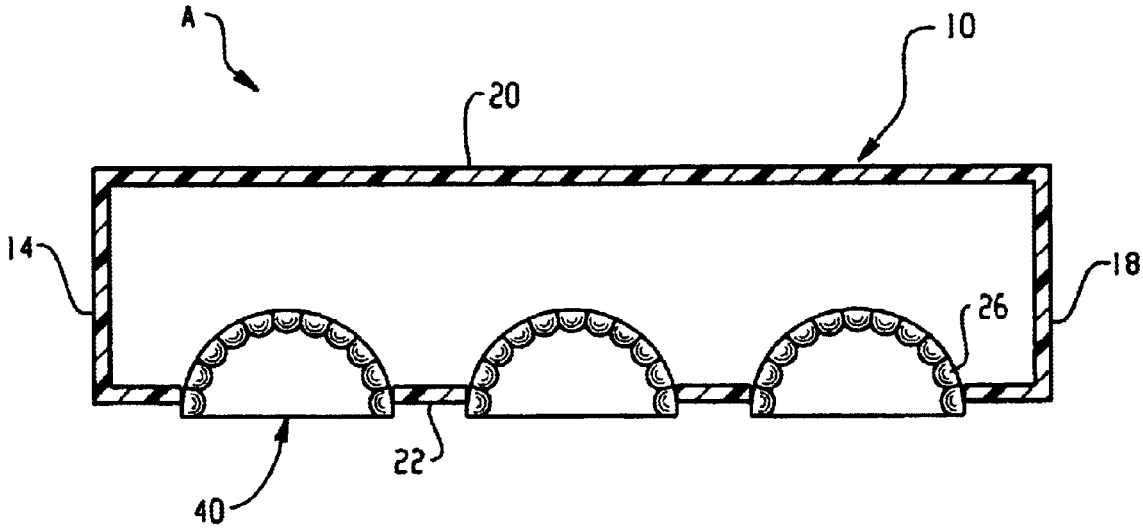
FIG. 4 is a cross sectional view of an undercabinet lighting assembly in accordance with the present invention.

Each LED array forming the light source includes an optical assembly 40 (see FIG. 4) for focusing and dispersing an LED beam emitted by the LED array. Included is a part of the optical assembly are one or more reflectors and one or more lenses to provide directional control. The optical assembly 40 is adapted to move or rotate so that the focus of the lens and the dispersion of the LED beam can be adjusted as desired. Alternatively, the focus and dispersion may be adjusted by fixing the optical lens and allowing the LED array to move or rotate. In order to adjust the lens or LED array, a manually operated focusing knob 42 (see FIG. 1) is provided on one of the sidewalls 18 of the housing 10. However, any other known means for adjusting the optical lens or LED array is contemplated by the present invention.

A switch 44, coupled to a variable resistor 46, is provided on the exterior of the housing 10 for allowing variable optical output. The switch 44 can be designed as a rheostat so that it is possible to change the resistance value without interrupting the circuit to which it is connected. As such, a user may adjust the optical output to any desired level.

Figure 5:
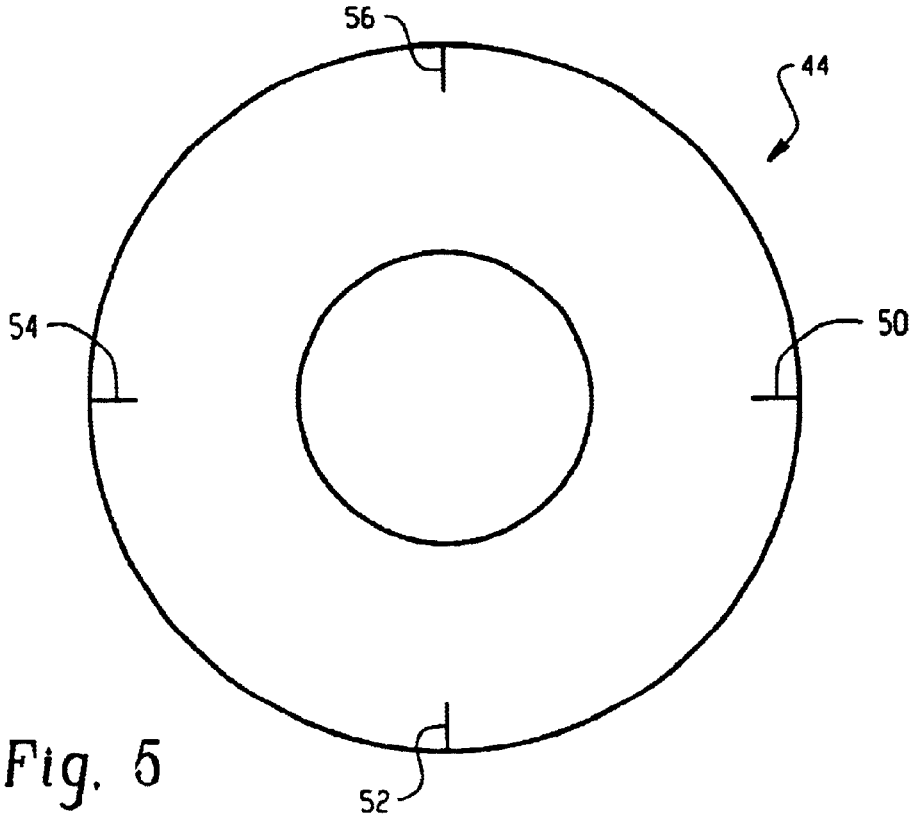
FIG. 5 is an enlarged view of a step level variable switch in accordance with the present invention.
Figure 6:
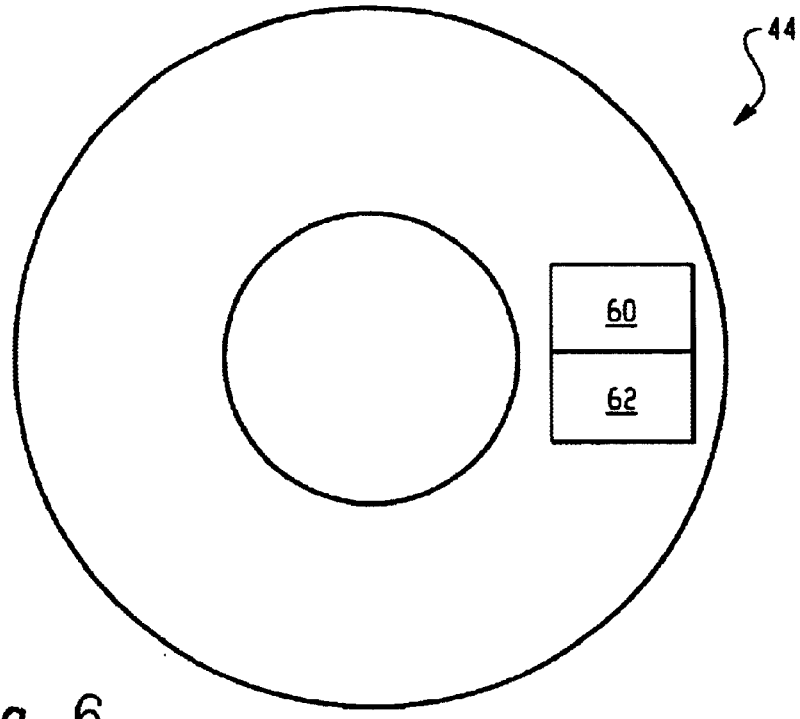
FIG. 6 is an enlarged view of a combined step level and continuous level variable switch in accordance with the present invention.

Alternatively, or in addition to the rheostat design, the switch 44 can be designed having step level variable control which allows a user to choose from distinct levels of illumination as shown in FIG. 5. In FIG. 5, a rotatable switch 44 is shown with indicia representative of four different illumination levels or choices. In order to actuate the light source, the switch is pressed in the axial direction thereby illuminating the lamp. After the light has been turned on, the level of optical output may be adjusted by rotating the switch. In the illustrated embodiment, the switch can be rotated to four distinct positions 50, 52, 54, 56 corresponding to four different levels of optical output. For each 90° of rotation, the level of optical illumination increases, for example, by 25% until full illumination is achieved at a twelve o'clock position. It will be appreciated however that any number of positions corresponding to any level of optical illumination is contemplated by the present invention. For example, the switch may be designed having two modes of illumination. Turning to FIG. 6, the first mode 60 provides full illumination while the second mode 62 provides partial illumination. When operating at partial illumination, the undercabinet light source is equivalent to a night-light. As illustrated, such a design may be used in conjunction with a rheostat variable resistor.

In addition to allowing the user to adjust the optical output of the light source, the switch 44 may be adapted to enable the user to selectively turn on and off any number of LEDs in each array. In order to achieve such a feature, the variable resistor 46 is designed to selectively short-circuit predetermined sections of the resistor or switch certain LEDs out of the circuit. Therefore, the user can operate the switch to selectively turn on and off any number of LEDs as desired.

Returning now to FIG. 1, the undercabinet lighting assembly is preferably connected to a power source, such as an AC power source, via cord 64 adapted to plug into any conventional electrical outlet (not shown). However, due to the inherent high efficiency of the device, the power source may be a capacitor or any other energy storage means. In addition to the primary power source, a battery back up system 70 is provided. The battery back-up system allows for emergency lighting upon failure of the AC source. The battery system includes a cavity 72, disposed in one of the walls of the housing, which operates as a battery compartment 72 for containing batteries 74. The batteries can be of any desired type and size, including but not limited to alkaline, nickel cadmium, standard, heavy duty, lithium, nickel metal hydride and other. A power source selector 76 is provided on one of the sides 18 of the housing which determines what source of power the lamp will use during operation. An AC power source indicator 78 and a battery source indicator 80 are disposed on the front side 14 of the housing 10 for indicating which source of power is being utilized. One skilled in the art will appreciate that the battery life can be controlled by the switch 44.

Figure 7:
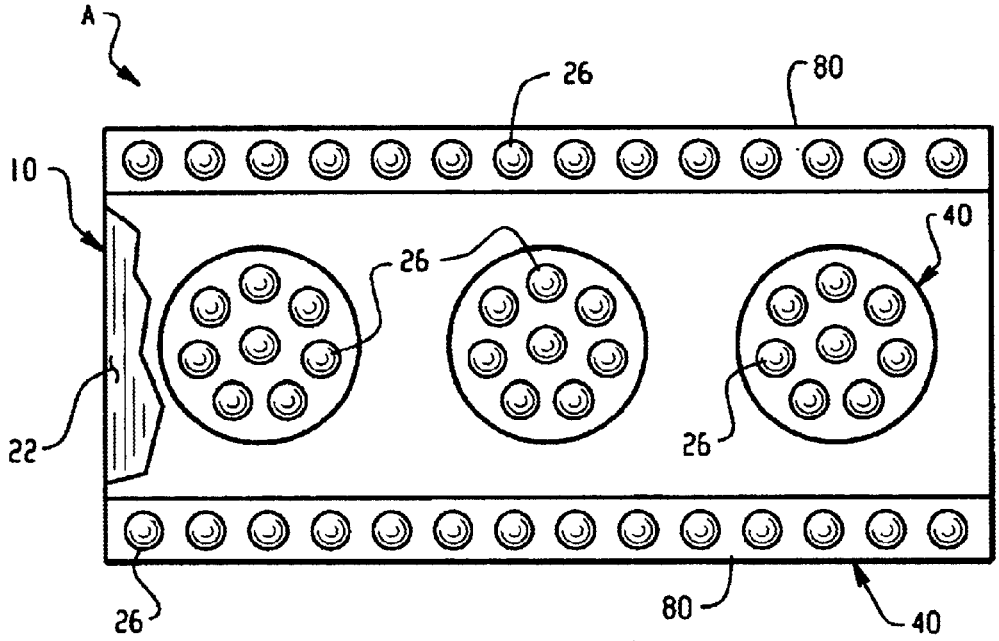
FIG. 7 is a bottom view of another preferred undercabinet lighting assembly in accordance with the present invention.

In an exemplary embodiment, the battery back up system 70 is adapted to automatically turn on the light source upon failing or faulting of the primary power source. A sensor (not shown) detects when AC power is no longer available and sends a signal to the battery system to supply power to the light source. A power-fail switch 82 is provided on one of the sides of the housing for setting, testing, and resetting the power-fail system. Optionally, the undercabinet lighting assembly includes at least one lighting rail 84 (see FIG. 7) having a plurality of LEDs arranged linearly across the bottom face of the housing. In the illustrated embodiment, two lighting rails are disclosed. Upon primary power failure, the battery system 70 operates to activate the lighting rails and provide illumination. This feature is particularly useful during the night.

Figure 8:
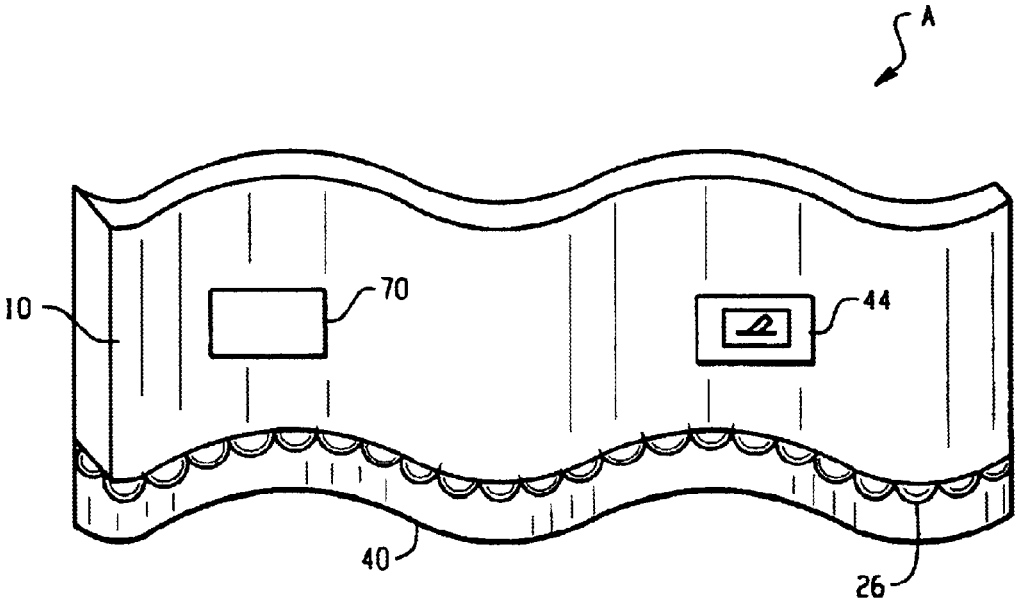
FIG. 8 is a perspective view of a flexible undercabinet lighting assembly in accordance with the present invention.

Referring now to FIG. 8, the housing of the undercabinet lighting assembly may be a flexible material such as rubber or an elastomeric material. As such, the housing can be bent into any shape or configuration as desired. The flexible housing 10 allows the user to utilize the light source in several different environments. Such a feature may be achieved because of the unique characteristics of LEDs. LED light sources have significantly fewer components than standard fluorescent or incandescent lamps. In addition, unlike standard fluorescent and incandescent lamps, LEDs do not have fragile parts such as filaments, electrodes, etc. Therefore, LED light sources do not require a large housing made from a protective rigid material and can thus be made of a flexible material.

The invention has been described with reference to the preferred embodiment. Obviously, modifications and alterations will occur to others upon a reading and understanding of this specification. The invention is intended to include all such modifications and alterations in so far as they come within the scope of the appended claims and the equivalents thereof.

What is claimed is:

1. An undercabinet lighting assembly comprising:

a housing;

a first plurality of Light Emitting Diodes (LEDs) mounted within the housing forming at least one array of LEDs, the LEDs generating an LED beam and serving as a light source;

a switch coupled to a variable resistor for controlling a level of optical output;

an optical assembly operatively associated with the housing for focusing and dispersing the LED beam traveling through said optical assembly to a desired light contour; and a fixing apparatus disposed on a surface of the housing for attaching the undercabinet lighting assembly to an associated structure.

2. The undercabinet lighting assembly according to claim 1, wherein the switch is adapted to selectively turn on and off any select number of LEDs within the array of LEDs.

3. The undercabinet lighting assembly according to claim 1, wherein the switch provides a step level variable control having at least two distinct levels of illumination.

4. The undercabinet lighting assembly according to claim 3, wherein the switch has a first level adapted to provide partial illumination equivalent to night-light functionality and a second level adapted to provide full illumination.

5. The undercabinet lighting assembly according to claim 1, wherein the switch operates as a rheostat having continuous variable control.

6. The undercabinet lighting assembly according to claim 5, wherein the switch further includes a step level variable control thereby allowing a user to choose between a step level mode of operation and a rheostat mode of operation.

7. The undercabinet lighting assembly according to claim 1, wherein the first plurality of LEDs have multiple colors of spectral output for achieving desired light output, light level, and beam characteristics.

8. An undercabinet lighting assembly comprising:

a housing;

a first plurality of Light Emitting Diodes (LEDs) mounted within the housing forming at least one array of LEDs, the LEDs generating an LED beam and serving as a light source;

an optical assembly operatively associated with the housing for focusing and dispersing the LED beam traveling through said optical assembly to a desired light contour;

a fixing apparatus disposed on a surface of the housing for attaching the undercabinet lighting assembly to an associated structure; and further comprising a battery pack having a battery source enclosed by the fixture housing for providing back up power and emergency lighting.

9. The undercabinet lighting assembly according to claim 8, wherein the battery source automatically provides power to the undercabinet lighting assembly upon primary power failure.

10. An undercabinet lighting assembly comprising:

a housing;

a first plurality of Light Emitting Diodes (LEDs) mounted within the housing forming at least one array of LEDs, the LEDs generating an LED beam and serving as a light source;

an optical assembly operatively associated with the housing for focusing and dispersing the LED beam traveling through said optical assembly to a desired light contour; and a fixing apparatus disposed on a surface of the housing for attaching the undercabinet lighting assembly to an associated structure;

wherein the optical assembly is continuous and encapsulates the LED array, and is selectively adjustable for focusing and dispersing the LED beam as desired.

11. An undercabinet lighting assembly comprising:

a housing;

a first plurality of Light Emitting Diodes (LEDs) mounted within the housing forming at least one array of LEDs, the LEDs generating an LED beam and serving as a light source;

an optical assembly operatively associated with the housing for focusing and dispersing the LED bean traveling through said optical assembly to a desired light contour;

a fixing apparatus disposed on a surface of the housing for attaching the undercabinet lighting assembly to an associated structure;

wherein the optical assembly encapsulates the LED array and is fixed and the array of LEDs serving as the light source is selectively moveable for focusing and dispersing the LED beam as desired.

12. An undercabinet lighting assembly comprising:

a housing;

a first plurality of Light Emitting Diodes (LEDs) mounted within the housing forming at least one array of LEDs, the LEDs generating an LED beam and serving as a light source;

an optical assembly operatively associated with the housing for focusing and dispersing the LED beam traveling through said optical assembly to a desired light contour;

a fixing apparatus disposed on a surface of the housing for attaching the undercabinet lighting assembly to an associated structure; and further comprising a second plurality of LEDs for providing lower levels of illumination, the second plurality of LEDs being separate and distinct from the first plurality of LEDs, the second plurality of LEDs adapted to automatically turn on upon primary power failure.

13. The undercabinet lighting assembly according to claim 1, wherein the housing is formed from a flexible material allowing the undercabinet lighting assembly to adopt a desired shape.

14. An undercabinet lighting assembly comprising:

a housing; and a first plurality of Light Emitting Diodes (LEDs) mounted within the housing forming at least one array of LEDs, the array of LEDs generating an LED beam and serving as a light source, said first plurality LEDs being powered by an AC power source and a battery source upon failure of the AC power source including a switch having a variable resistor for controlling a level of optical output.

15. The undercabinet lighting assembly according to claim 14, further comprising a switch formed from a variable resistor for controlling a level of optical output.

16. The undercabinet lighting assembly according to claim 14, wherein the switch is adapted to selectively turn on and off any select number of LED's within the at least one array of LED's, thereby allowing a user to choose from several different levels of illumination.

17. The undercabinet lighting assembly according to claim 14, wherein the switch operates as a step level variable control having at least two distinct levels of illumination.

18. The undercabinet lighting assembly according to claim 17, wherein the switch has a first level of illumination adapted to provide partial illumination equivalent to night-light functionality and a second level of illumination adapted to provide full illumination.

19. The undercabinet lighting assembly according to claim 14, wherein the switch operates as a rheostat having continuous variable control.

20. The undercabinet lighting assembly according to claim 19, wherein the switch further includes a step level variable control thereby allowing a user to choose between a step level mode of operation and a rheostat mode of operation.

21. The undercabinet lighting assembly according to claim 14, wherein the first plurality of LEDs have multiple colors of spectral output for achieving desired light output, light level, and beam characteristics.

22. The undercabinet lighting assembly according to claim 14, wherein the battery source automatically provides power to the undercabinet lighting assembly upon primary power failure.

23. The undercabinet lighting assembly according to claim 14, further comprising at least one continuous, encapsulating optical assembly operatively associated with the housing which is selectively adjustable for focusing and dispersing the LED beam.

24. The undercabinet lighting assembly according to claim 23, wherein the optical assembly encapsulates at least one of the array of LEDs and is fixed, and the array of LEDs serving as the light source is selectively moveable for focusing and dispersing the LED beam.

25. The undercabinet lighting assembly according to claim 14, further comprising a second plurality of LEDs for providing lower levels of illumination, the second plurality of LEDs being separate and distinct from the first plurality of LEDs, the second plurality of LEDs being operative in response to primary power failure.

26. The undercabinet lighting assembly according to claim 14, wherein the housing is formed from a flexible material.

* * * * *